United States Patent [19]

Snow

[11] 4,115,778

[45] Sep. 19, 1978

[54] ELECTRONIC SOLID STATE FM DIPOLE ANTENNA

[75] Inventor: Robert Eric Snow, Raleigh, N.C.

[73] Assignee: JFD Electronics Corporation, Oxford, N.C.

[21] Appl. No.: 742,680

[22] Filed: Nov. 18, 1976

[51] Int. Cl.[2] ..... H01Q 1/26

[52] U.S. Cl. ..... 343/701; 343/803; 343/821; 325/375

[58] Field of Search ..... 343/741, 742, 743, 744, 343/803, 701, 821; 325/375

[56] References Cited

U.S. PATENT DOCUMENTS

| | | | |
|---|---|---|---|
| 2,116,734 | 5/1938 | Reinartz | 343/741 |
| 2,682,608 | 6/1954 | Johnson | 343/803 |
| 3,656,160 | 4/1972 | Burton | 343/742 |
| 3,745,583 | 7/1973 | Herbert | 343/742 |
| 3,956,751 | 5/1976 | Herman | 343/744 |

*Primary Examiner*—Eli Lieberman
*Attorney, Agent, or Firm*—Bernard Malina

[57] ABSTRACT

A miniature antenna which is rugged, extremely lightweight and which is especially adapted for reception across the entire FM band comprising an omnidirectional half-wave dipole having feed structure comprised of curved overlapping dipole element points connected to a solid state amplifier having staggered tuned input and output circuits. The input to the amplifier is maintained essentially balanced to preserve the omnidirectional pattern of the dipole.

The physical location of the solid state amplifier is such that it is directly connected to the feed point of the dipole eliminating transmission line losses.

The coaxial cable is employed in a diplexed manner for connecting the DC power supply to the solid state amplifier and for connecting the amplified output signal to an impedance converter which is to provide proper impedance match for the antenna input signals of an FM tuner/receiver. The design provides an omnidirectional E-plane pattern and the staggered tuned amplifier provides adequate gain across bandwidth sufficient to cover the FM band.

2 Claims, 8 Drawing Figures

E-PLANE RADIATION PATTERN
FREQUENCY 98 MHZ

ELECTRONIC SOLID STATE FM DIPOLE ANTENNA

BACKGROUND OF THE INVENTION

It is conventional to employ straight dipole antennas for the transmission and/or reception of signals in FM bandwidth in the range from 88 to 108 MHz. Half-wave dipoles, i.e., wherein the tip-to-tip electrical length of the dipoles is one-half wave length at the operating frequency, are typically employed for FM reception. For example, a straight dipole at the low end of the FM range and which is resonant at 88 MHz, has a tip-to-tip electrical length, for a half-wave dipole, which is approximately 67 inches. At mid-range, i.e., 98 MHz, tip-to-tip length of the half-wave straight dipole is 59 inches while the tip-to-tip length of a half-wave straight dipole resonant at 108 MHz is approximately 54.5 inches. It is quite common to use three active dipoles coupled to form an antenna array to obtain signal gain sufficient for the desired FM reception. Such dipoles require a large amount of mounting space and typically cannot be accommodated within confined areas, such as apartments, hotel rooms, trailers and other mobile units, or in any application where space is at a premium. In addition, straight dipoles of the type described hereinabove are highly directional and require the exercise of some care in order to set the antennas up properly for best reception or, alternatively, require expensive antenna rotating units, especially in cases where the FM transmitters within a particular area are clustered in a circular mounter about the FM receiving unit.

It is thus extremely desirable to be able to provide an antenna design of significantly reduced size and weight and having a desirable omnidirectional pattern so as to avoid the careful set up of an antenna or for that matter the continual azimuthal alignment of an antenna each time reception from a different transmitter is desired.

The present invention is characterized by providing a highly miniaturized light-weight, rugged FM antenna employing a novel curved overlapping dipole design in which the space occupied by the antenna is significantly reduced, as compared with straight dipoles. In addition to the above, a solid state amplifier is employed which is so designed as to provide adequate gain over the entire FM band in spite of the fact that only one dipole structure is employed in the antenna design. The physical positioning of the solid state amplifier in extremely close proximity to the antenna feed points to permit direct connection therebetween, eliminates transmission line losses which would otherwise occur.

The solid state amplifier is sufficiently miniaturized so as to occupy an insignificant amount of space within the dust proof, weather-proof housing provided to completely enclose the antenna. The remotely located power supply for the solid state amplifier is coupled to the solid state amplifier through a coaxial cable which is utilized in a novel diplexed manner, coupling DC power through the amplifier and simultaneously coupling the amplified output signals back to the power supply whereupon the received signal is converted from 75-ohm unbalanced to a 300-ohm balanced signal which is highly suitable for connection to the antenna input terminals of an FM tuner/receiver.

The stagger-tuned design of the solid state amplifier serves to provide adequate gain over the entire FM band to further assure that the desired omnidirectional E-plane pattern is obtained, thereby substantially totally eliminating any need for rotating or otherwise changing the position of the antenna assembly for purposes of improving signal reception, even in cases where transmitting stations are located in different angular positions about an azimuthal plane.

The light-weight housing is formed of a rugged and yet aesthetically pleasing plastic material in substantially disked shaped form and is adapted to be mounted quickly and readily by a supporting bracket on either interior or exterior supports and is further adapted to receive short leg elements which may be releasably secured thereto for sturdily supporting the structure for any flat or reasonably flat surface.

In one preferred embodiment, the curved dipole arms which are arranged in substantially coplanar fashion and are tuned preferably to the mid point of the FM band (of the order of 98 MHz) and may be securely and compactly housed within the protective housing whose external diameter is only 11 inches and whose thickness or height is of the order of 1 inch. The dipole antenna structure is preferably comprised of twin lead secured along the interior cylindrical wall of said housing.

The light-weight small attractive appearance makes it possible to place the antenna in regions where space is limited, such as apartment, hotel rooms, homes and the like. The attractive appearance does not detract from the use and placement of the antenna as part of the decor. In buildings employing steel superstructures the antenna is small enough to be conveniently placed next to a window or even outside a window to place the antenna in a position where the steel superstructure does not affect signal reception.

The antenna is provided with a versatile mounting bracket to facilitate its mounting on walls in attics and on masts indoors or outdoors. The light-weight even permits its mounting by means of a double sided pressure sensitive adhesive strip.

OBJECTS AND BRIEF DESCRIPTION OF THE FIGURES

It is therefore one object of the present invention to provide a novel miniaturized antenna especially adapted for the reception of signals within the FM band and which is adapted to provide an omnidirectional E-plane radiation pattern so as to completely avoid the need for repositioning of the antenna in cases where reception from another FM transmitter is desired.

A further object of the present invention is to provide a novel antenna especially adapted for reception of signals in the FM band in which a single dipole is employed and wherein the space occupied by the dipole is significantly reduced due to the curved overlapping arrangement of the dipole arms.

Another object of the present invention is to provide a novel antenna of reduced size and which is adapted for reception of signals in the FM band wherein the curved overlapping dipole arms, in combination with a solid state stagger-tuned amplfier, cooperatively serve to provide an omnidirectional E-plane radiation pattern having suitable gain over the entire FM band and through the use of only a single active dipole structure.

Still another object of the present invention is to provide a novel curved dipole arrangement and rugged light weight housing therefor which is of disked shape so as to significantly reduce the antenna size while at the same time providing a rugged high performance antenna assembly and wherein the housing is further designed to greatly facilitate the positioning mounting and/or installation of the antenna assembly.

The above as well as other objects of the present invention will become apparent while reading the accompanying description of drawings in which.

Figure 2:
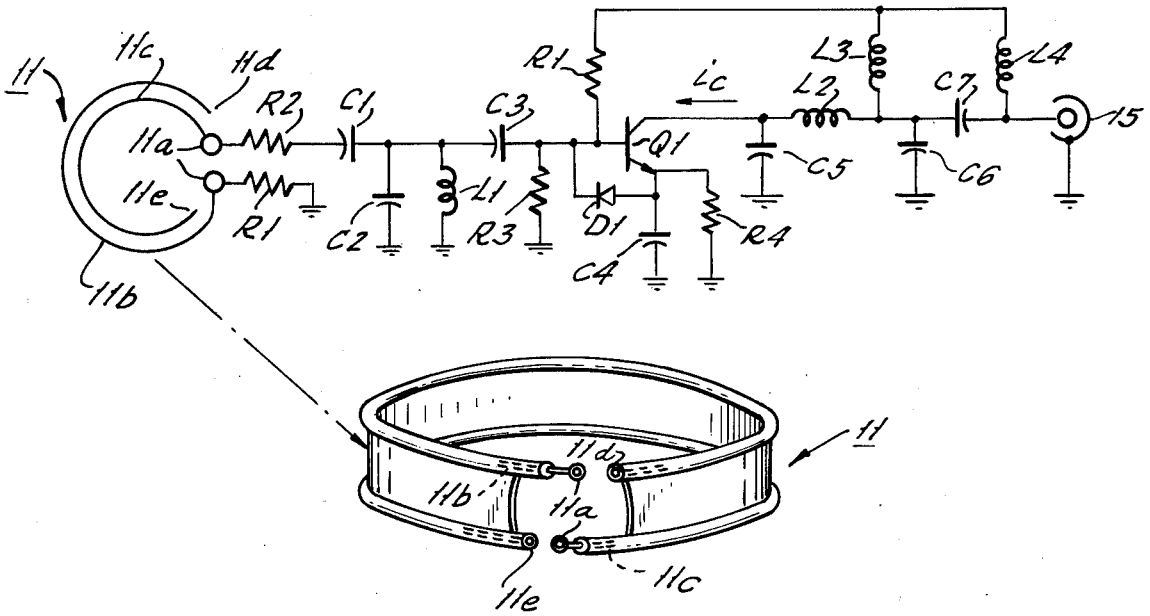
FIG. 2 shows a detailed schematic of the antenna section of the miniature FM antenna of FIG. 1.
Figure 4A:
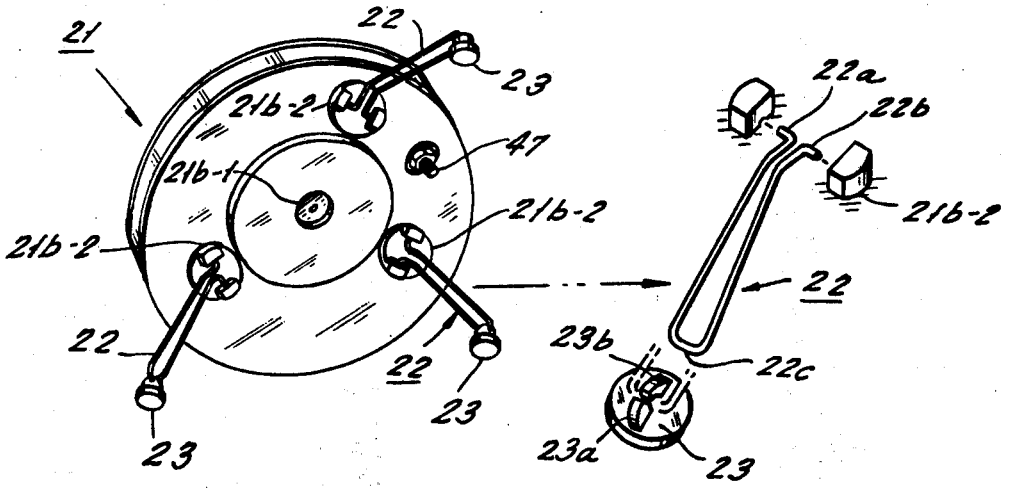

FIG. 4*a* shows a perspective view of the housing and support legs for the antenna section of FIG. 2.

Figure 4B:
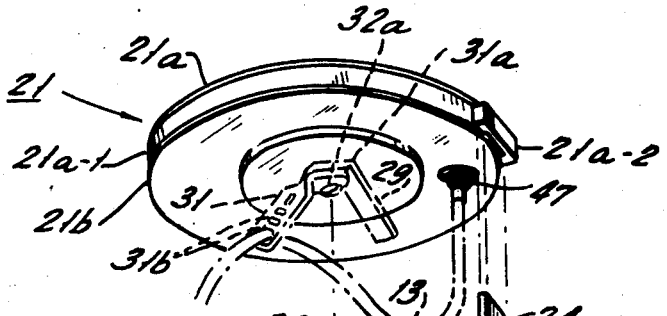

FIG. 4*b* shows a perspective view of the antenna housing type shown in FIG. 4*a* and employed with mounting hardware to facilitate either indoor or outdoor installations.

Figure 3:
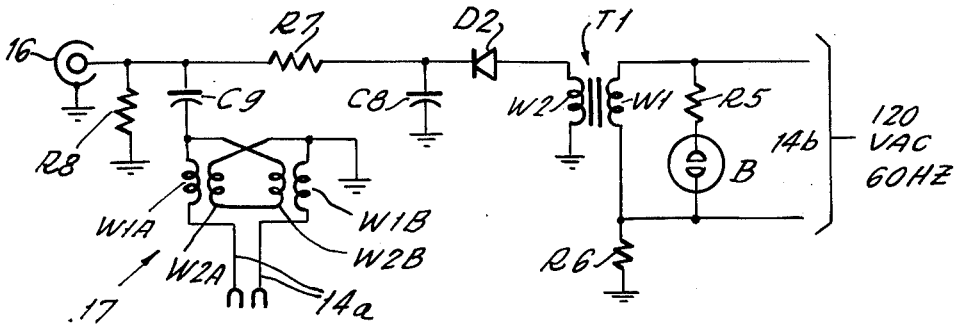
FIG. 3 shows a detailed schematic diagram of the power supply and impedance conversion circuitry of FIG. 1.
Figure 4C:
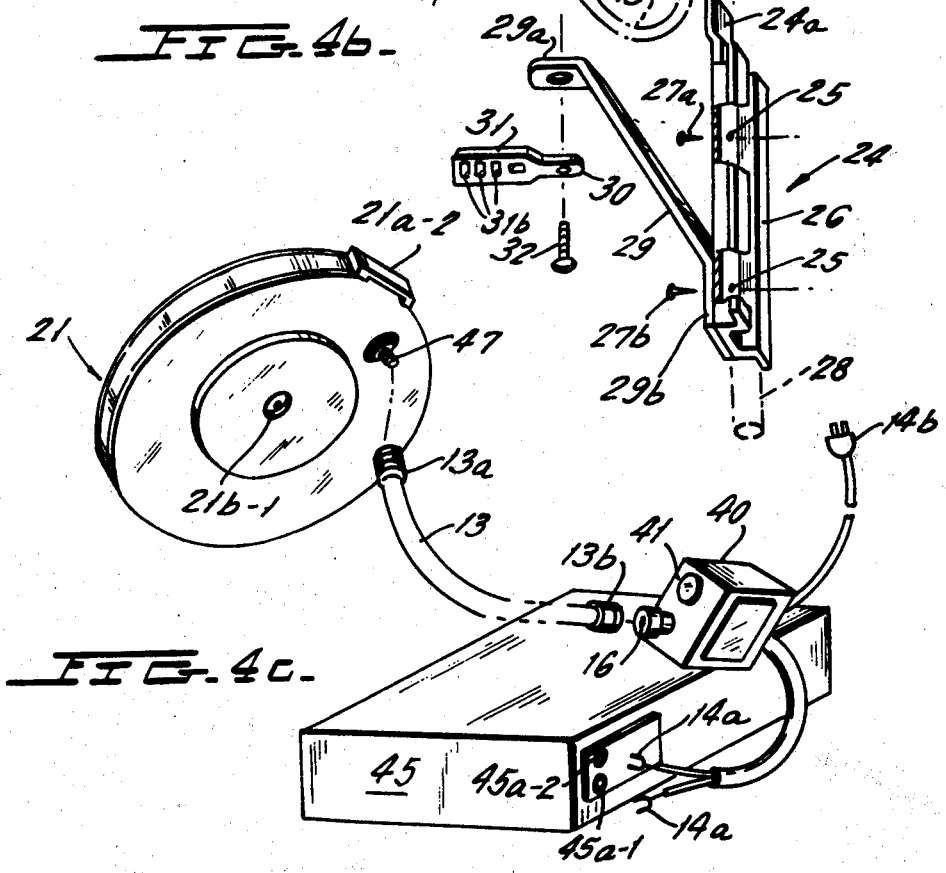

FIG. 4*c* is a perspective view showing the antenna arrangement of FIG. 4*a* further including the power supply-impedance conversion circuitry of FIG. 3 and the housing therefor as well as the interconnecting coaxial cable, and further showing the manner in which the output leads of the impedance conversion circuit are connected to an FM receiver/tuner.

Figure 5A:
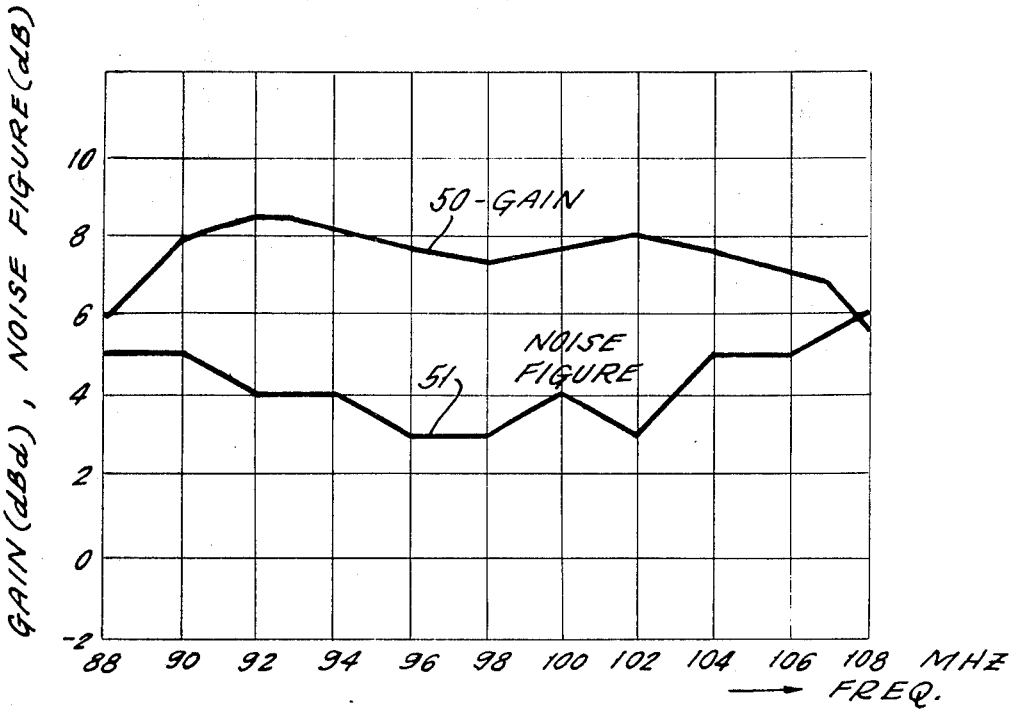

FIG. 5*a* shows a plot of the noise figure and gain for the antenna design of the present invention plotted over the FM band.

Figure 5B:
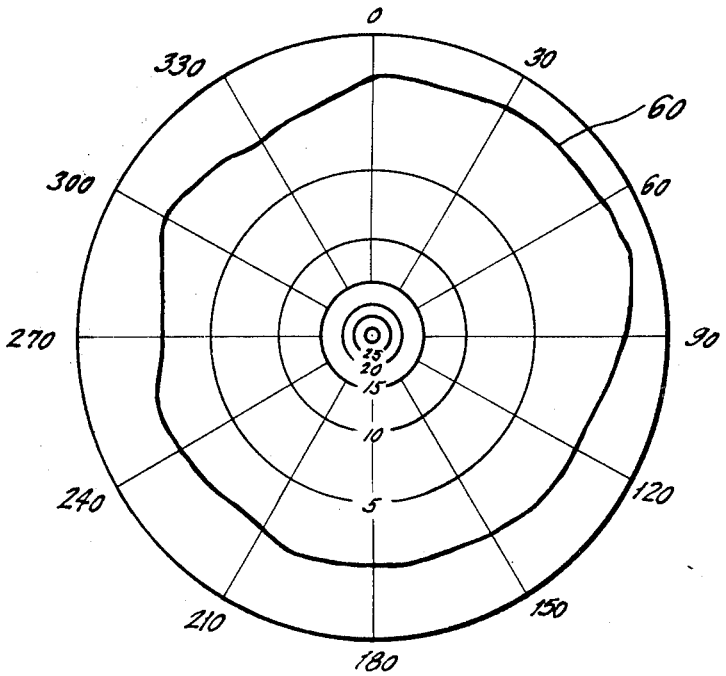

FIG. 5*b* shows the E-plane radiation pattern for the antenna of the present invention.

DETAILED DESCRIPTION OF THE INVENTION

Figure 1:
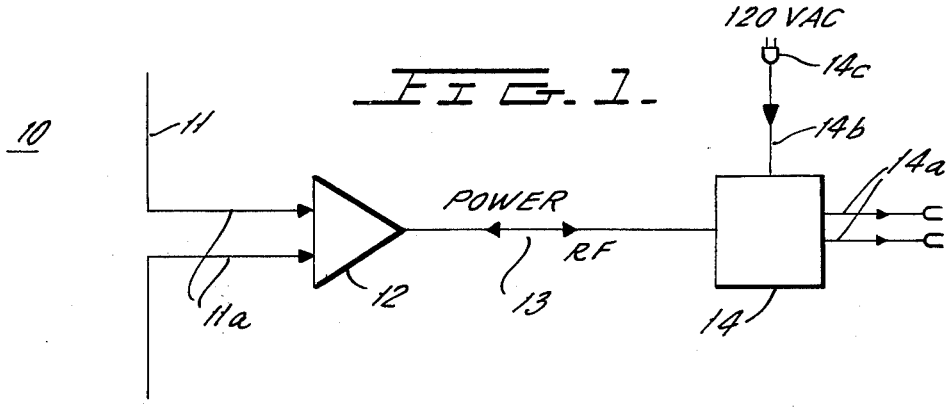
FIG. 1 shows a simplified block diagram of the basic elements of the miniature FM antenna of the present invention.

FIG. 1 shows a highly simplified diagram of the FM antenna 10 of the present invention which is comprised of the half-wave dipole 11 having dipole arms whose tip-to-tip electrical length is tuned to resonate preferably at the middle of the FM band or at 98 MHz so that the tip-to-tip electrical length for a straight dipole arrangement is of the order of 60 inches. The dipole feed points 11*a* are coupled to RF amplifier 12 which is shown in a highly simplified manner and is physically located immediately adjacent the dipole feed points so as to eliminate transmission losses. The amplifier is further of the stagger tuned typed to provide suitable gain over the entire FM bandwidth while providing a solid state amplifier of extremely small size. The amplified signal is coupled to a combination power supply/impedance conversion circuit 14 through a coaxial cable 13 which is utilized in a diplexed manner in order to couple DC power to amplifier 12 while at the same time being adapted to couple the amplified FM signal received from a remote FM transmitter to the impedance conversion circuit provided within the block 14. The output leads 14*a* are preferably 300 ohm cable (i.e., twin-lead) and are adapted to connect the amplified FM signal to the input terminals of an FM receiver/tuner. The circuit block 14 is further provided with a power cord 14*b* provided at its free end with a conventional plug 14*c* for connection into a conventional 120 volt 60 Hz supply which signal is converted by the power supply unit (to be more fully described) to provide a DC signal of the desired level in order to power the solid state amplifier with suitable DC bias levels.

As will become readily apparent from the ensuing description, the antenna arrangement of FIG. 1 provides a very desirable omnidirectional pattern over the entire FM band.

FIG. 2 shows a detailed schematic diagram of the antenna section of FIG. 1 and is comprised of the pair of dipole arms 11*b* and 11*c* whose inboard ends define the antenna feed points 11*a*. As can clearly be seen from FIG. 2, each arm, which has a length of the order of one-quarter wave length of the resonant frequency, is substantially circular-shaped and the diameters of the inner and outer arms 11*b* and 11*c* are adapted to lie upon an imaginary circle whose diameter is of the order of 11 inches. The arms are arranged one above the other and have their outboard ends 11*d* and 11*e* relatively close to one another especially as compared with a straight dipole arrangement, for example, of the type shown in the simplified diagram of FIG. 1. Although bent or otherwise formed in a circular manner, the preferred embodiment of the present invention is such that the dipole is designed to resonate at the mid frequency point of the FM band, i.e., at a frequency of the order of 98 MHz (± 2 MHz) so that at one-half wave length of the resonant frequency, tip-to-tip length is of the order of 60 inches. In the present design, by bending or otherwise forming the dipole arms in the circular fashion as shown, both arms can be arranged so as to lie within a circumscribed imaginary circle which has a diameter of the order of less than 11 inches.

The feed points are respectively coupled to the associated terminal of each of the resistors R1 and R2, the opposite terminal of R1 being grounded. R2 is coupled to the capacitor C1 which in turn is connected in common to C2, inductor L1 and capacitor C3. Elements C2 and L1 are arranged in electrical parallel, their remaining terminals being grounded. C3 is connected in common to one terminal of grounded resistor R3, the cathode of diode D1, the base electrode of transistor Q1, and one terminal of resistor R1. Elements C1–C3 and L1 cooperatively form a tuned circuit which is tuned to enhance the gain of signals occurring at frequencies at the low end of the FM band.

The emitter electrode of Q1 is coupled to ground through the parallel path of R4 and C4 while the collector is coupled to a second tuned circuit comprised of C5, L2, C6 and C7. Inductors L3 and L4 each have one of their terminals connected in common to one terminal of R1 and their remaining terminals connected to associated terminals of C7. L3 and L4 couple DC power to Q1 while blocking RF energy from being fed back from the collector to the base of the transistor. The coaxial coupling 15 is provided to couple the amplifier to the remotely located circuit block 14 as shown in simplified fashion in FIG. 1 and shown in detailed schematic fashion on FIG. 2.

The first and second tuned circuits are respectively tuned to be resonant near the lower and upper ends of the FM band so as to provide a staggered tuned arrangement. The staggered tuned circuits forming part of the solid state amplifier function to increase gain of signal frequencies in their resonant regions to improve gain at both ends of the frequency band of interest.

FIG. 3 shows a schematic diagram of the circuit block 14 of FIG. 1 which is comprised of the power leads 14*b* coupled at their right hand ends to a 120 volt 60 Hz line while the left hand ends are coupled to an input winding W1 of a transformer T1. Resistor R5 and neon lamp B are connected in parallel across winding W1. The voltage across the series connected elements R5 and B is sufficient to illuminate lamp B and thereby provide a positive indication of the fact that the AC power is available. Winding W1 is connected through resistor R6 to ground. Leads 14*a*, connected to the receiver (see also FIG. 4C) are also connected through windings W1 and W2 and capacitor C9 to the antenna 16. Winding W1*a* has one terminal connected to ground through windings W2*b* and W2*a*. Winding W1*b* also has one grounded terminal. The power supply to the system is rectified by diode D2 and an appropriate power diplexing circuit is provided by a capacitor C8 and members R7 and R8, in that C8 shunts RF energy to ground; C9 directly couples RF energy to terminals 14*a*; low freguency rectified energy from D2 is directly coupled to the collector of Q1.

FIG. 5A as previously pointed out shows, a plot of the noise figure and gain for the intended design of the present invention plotted over the entire FM band. FIG. 5B shows the E plane radiation pattern for the antenna of the present invention, showing that for all practical purposes the radiation line 60 is fully circular thereby enabling the antenna to receive unidirectionally.

In FIG. 5A the curve 50 for gain and the curve 51 for noise illustrate that the difference between the two curves is such that the antenna is functional and fully operative to receive over the entire FM frequency band.

Structually the antenna housing 21 may be made of various materials which permit free passage of FM radio frequency, such materials may include plastic as well as other materials. As seen in FIG. 4A the housing 21 may be provided with leg sockets 21*b* each of which comprises a recessed block having an opening therein as seen particularly at the right hand extension of FIG. 4A into which the extensions 22*a*, 22*b* of each of the legs 22 fit. Legs 22 are spring members preferably of a springy plastic, although since they are out of the plane of radiation, may actually be of metal; the extensions 22, 22*a* may thus be squeezed together and sprung into the blocks of 21*b*.

Where the antenna structure is to be mounted on a flat surface or serve as a decorative element the connector 22*c* at the bottom of each leg 22 may be snapped into the resilient recess 23*a* of the resilient foot 23 in order to provide appropriate anti-marring surface for the legs. The section 21B1 may also be provided for a post type of support or for support of brackets or other elements as hereinafter described.

The connector 47 may be a coaxial type connector or may be provided with a double contact nipple or jack arrangement so that the lead 13 of FIG. 1 (see also FIG. 4B) may appropriately be connected to the internal antenna structure 11 (of FIGS. 1 and 2) or 16 (of FIG. 3).

Where the antenna housing 21 is to be mounted on a wall bracket the wall bracket may consist of a principal structure having the flanges 26 and the securing openings 25, 25 through which screws 27*a*, 27*b* may be inserted. The antenna housing 21 may be provided with the peripheral socket 21*a*2 which will slip over the projecting upper end 24*a* of support bracket 24, reinforcing bracket 29 having bent ends 29*a* and 29*b*, has its arm 29*b* provided with an opening registering with lower opening 25 in bracket 24. Screw 27*b* serves to secure the lower ends of brackets 24 and 29 to a support or pole 28. Arm 29*a* receives screw 32*a* which threadedly engages opening 32*a*. A lead support member 31 which preferably provides stress relief for lead 31, has an extension 31*a*, having an appropriate opening through which the mounting screw 32 passes. The lead 13 may be supported in order to relieve any possible stress on the lead or on the connection at 47 and 13*a*, by being force-fitted into one of the slots 31*b*.

In FIG. 4*c* there is shown the utilization of the antenna structure in connection with a receiver 45 in which the terminals 14*a* are coupled to the antenna posts 45*a*1 and 45*a*2 of the receiver. Plug 14*b* of the amplifier structure 4o is connected to an appropriate power source. The external lead 13 of the amplifier structure 14 has a coaxial coupler 13*a* connected to the nipple 47 extending from the housing 21 of the antenna. The lead 13 is connected to the coaxial connector 16 of housing 40 its connector 13*b*.

In the foregoing the present invention has been described solely in connection with preferred illustrative embodiments thereof. Since many variations and modifications of the present invention will now be obvious to those skilled in the art, it is preferred that the scope of this invention be determined not by the specific disclosures herein contained but only by the appended claims.

I claim:

1. An antenna designed to provide omnidirectional reception over a predetermined frequency band comprising:

a single dipole assembly having first and second dipole substantially coplaner arms each having inboard and outboard ends;

a pair of closely spaced feed points for coupling energy from said assembly to associated circuitry, and being connected to said inboard ends;

each of said arms being bent or formed to lie along an imaginary circle of said arms being positioned slightly above the other and so that inboard ends of the arms lie along said imaginary circle and are spaced apart by a distance at least as great as the distance between said feed points; and solid state amplifier means coupled to said feed points for providing substantially constant gain over said frequency band to signals received from said feed points; and an AC to DC converter means having an input for coupling said means to a source of AC energy;

a cable coupling;

impedance conversion means coupled between the DC output side of said AC-DC converter means and said second coupling;

a coaxial cable coupled between said amplifier and said cable coupling for transferring DC energy to amplifier means and for transferring amplified signals received by said dipole assembly to said impedance conversion means;

said amplifier including impedance means coupled to said cable for coupling DC energy to said amplifier while blocking high frequency energy especially in said reception band.

2. The antenna of claim 1 wherein said cable is a 75-ohm coaxial cable and said impedance conversion means is adapted to convert the amplified signals from 75-ohm unbalanced to a balanced 300-ohm output suitable for connection to the receiver input terminals of an FM tuner/receiver.

* * * * *